US012622532B2

(12) United States Patent
Whitehead

(10) Patent No.: US 12,622,532 B2
(45) Date of Patent: May 12, 2026

(54) RETRACTABLE DRAWER STAND FOR CHILDREN

(71) Applicant: Jack Moore Whitehead, Brentwood, TN (US)

(72) Inventor: Jack Moore Whitehead, Brentwood, TN (US)

( * ) Notice: Subject to any disclaimer, the term of this patent is extended or adjusted under 35 U.S.C. 154(b) by 687 days.

(21) Appl. No.: 17/221,279

(22) Filed: Apr. 2, 2021

(65) Prior Publication Data

US 2022/0312989 A1 Oct. 6, 2022

(51) Int. Cl.
*A47D 13/06* (2006.01)
*A47B 77/10* (2006.01)

(52) U.S. Cl.
CPC ..... *A47D 13/065* (2013.01); *A47B 77/10* (2013.01)

(58) Field of Classification Search
CPC ..... A47D 13/065; A47B 77/10; A47B 46/00
USPC ..... 108/162, 165, 115, 42; 312/261, 258, 312/259, 298, 302, 303, 310; 297/130, 297/344.11
See application file for complete search history.

(56) References Cited

U.S. PATENT DOCUMENTS 2,133,807 A * 10/1938 Bushnell ..... A47B 17/036 312/22
2,236,557 A * 4/1941 Zalkind ..... A47B 88/9414 229/913
2,597,277 A * 5/1952 Anderson ..... A47B 83/045 312/317.3
2,627,854 A * 2/1953 Sava ..... F24B 1/205 312/258
2,672,384 A * 3/1954 Richards ..... A47B 77/10 312/317.1
2,716,307 A * 8/1955 Pollard ..... A47B 41/04 312/282
2,808,305 A * 10/1957 Jackson ..... A47B 43/00 312/258
3,009,752 A * 11/1961 Margulis ..... A47B 17/00 312/258
3,072,453 A * 1/1963 Evans ..... A47B 77/10 312/317.3
3,164,350 A * 1/1965 Taub ..... A47F 5/114 211/133.1
3,300,166 A * 1/1967 Wojciechowski ... B65D 5/4283 229/120.32
3,544,184 A * 12/1970 Laws ..... A47B 43/02 312/259
3,576,355 A * 4/1971 Stone ..... A47B 43/02 312/258

(Continued)

FOREIGN PATENT DOCUMENTS

GB 2376268 A * 12/2002 ..... E05G 5/006

*Primary Examiner* — Jose V Chen

(57) ABSTRACT

The convertible drawer contains a foldable child stand that retracts in and out of an existing cabinet. It has walls that fold up and a load bearing support that folds down. The device is intended to hold the weight of a child and contain them at a height to allow safe interaction with caregivers at the counter. The top portion of the walls are encased in foam, and the walls lock into place. The bottom support is held in place with magnets when not in use and folds down to supplement the stability and load capacity of the drawer slides. The device can be disassembled into a standard drawer once children have outgrown the need for elevation assistance.

6 Claims, 5 Drawing Sheets

(56) References Cited

U.S. PATENT DOCUMENTS 3,807,823 A * 4/1974 Rouse ..... A47B 43/02 108/157.14
4,382,641 A * 5/1983 Abel ..... A47B 29/00 312/26
4,484,787 A * 11/1984 Stephens ..... A47B 19/08 312/231
4,519,319 A * 5/1985 Howlett ..... A47F 5/116 108/180
4,561,706 A * 12/1985 Grati ..... A47B 43/02 312/258
4,569,564 A * 2/1986 Ahmann ..... A47B 23/044 312/258
4,579,401 A * 4/1986 Mears ..... A47B 43/00 312/258
4,660,904 A * 4/1987 Stephens ..... E04H 1/1255 312/258
4,709,972 A * 12/1987 LaBudde ..... A47B 21/06 361/679.19
4,846,304 A * 7/1989 Rasmussen ..... A47B 77/10 182/35
5,154,500 A * 10/1992 Chang ..... A47B 96/02 312/258
5,370,064 A * 12/1994 Sgabellone ..... A47B 3/00 108/165
5,382,087 A * 1/1995 Pouch ..... A47B 73/00 312/265.5
5,392,902 A * 2/1995 Vlastakis ..... A47F 5/116 108/165
6,039,419 A * 3/2000 Brown ..... A47B 3/0803 312/258
10,314,390 B2 * 6/2019 Waggoner ..... A47B 3/0809
2004/0089208 A1 * 5/2004 Zheng ..... A47B 43/02 108/165
2005/0029911 A1 * 2/2005 Sheng-Bin ..... A47B 67/04 312/258
2008/0116270 A1 * 5/2008 Wilson ..... G07C 13/00 235/386
2013/0169133 A1 * 7/2013 Johnson ..... A47B 88/70 312/298
2013/0264923 A1 * 10/2013 Brady ..... A47B 43/003 312/258

* cited by examiner

RETRACTABLE DRAWER STAND FOR CHILDREN

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A READ-ONLY OPTICAL DISC, AS A TEXT FILE OR AN XML FILE VIA THE PATENT ELECTRONIC SYSTEM

Not Applicable

STATEMENT REGARDING PRIOR DISCLOSURES BY THE INVENTOR OR A JOINT INVENTOR

Not Applicable

BACKGROUND OF THE INVENTION

1. Field of the Invention

This invention arose from a desire to create a device that permits better interaction with children in the kitchen but is quickly/easily stored when not in use. It is an improvement over prior art that is not as easily stored/concealed and over those that are not designed to safely contain/elevate children. Relevant prior art to this invention is found in U.S. Patent Class 108, Subclass 115 and in U.S. Patent Class 297, Subclass 344.11.

2. Description of the Related Art

There are currently multiple devices that are designed to hold children at counter height. This can be seen in U.S. Pat. No. 6,634,712 dated Oct. 21, 2003 and U.S. Pat. No. 5,421,636 dated Jun. 6, 1995. These devices serve a similar purpose of elevating children to a height where they can be more engaged with activities such as cooking, doing dishes, etc, but they are less convenient to store. These are free-standing towers that take up significant floor space.

Likewise, there are patents for retractable and foldable furniture, such as those seen in U.S. Pat. No. 3,680,942 dated Aug. 1, 1972, U.S. Pat. No. 4,236,460 dated Dec. 2, 1980, and U.S. Pat. No. 9,617,780 dated Apr. 4, 2017. These patents show a table that pulls out of a cabinet and unfolds, foldable furniture, and a pull-out step stool respectively. None of these objects have enclosed walls, a foam top, nor the purpose of supporting the weight of children at counter height. They have less secure bottom support pieces. They are not held in place with magnets and do not appear to lock in place as securely as the present invention.

I am unaware of any prior art that serves the same function and fits as quickly/seamlessly into the cabinets.

Improving the storability and having a stand always available in a desirable location will likely increase the amount of time kids spend in the kitchen learning about and preparing food. Outside of its unique combination of function and usage, I think the bottom support that is held in place with magnets, folds down from the middle, and then folds in from the lateral portion provides an extra dimension of stability that is not present in prior art.

BRIEF SUMMARY OF THE PRESENT INVENTION

This invention is a convertible drawer that serves as a retractable stand for children. It elevates them to counter height and enables them to safely assist in the kitchen. It slides in and out of a cabinet for easy storage and can hold multiple children. It can be built in different sizes to accommodate multiple cabinet sizes/configurations.

BRIEF DESCRIPTION OF THE DRAWINGS

The drawings show the invention from multiple angles and in all steps of operation. Going from left to right in FIGS. 1-4, you can see the 5 steps of opening and setting up the drawer.

Figure 1:
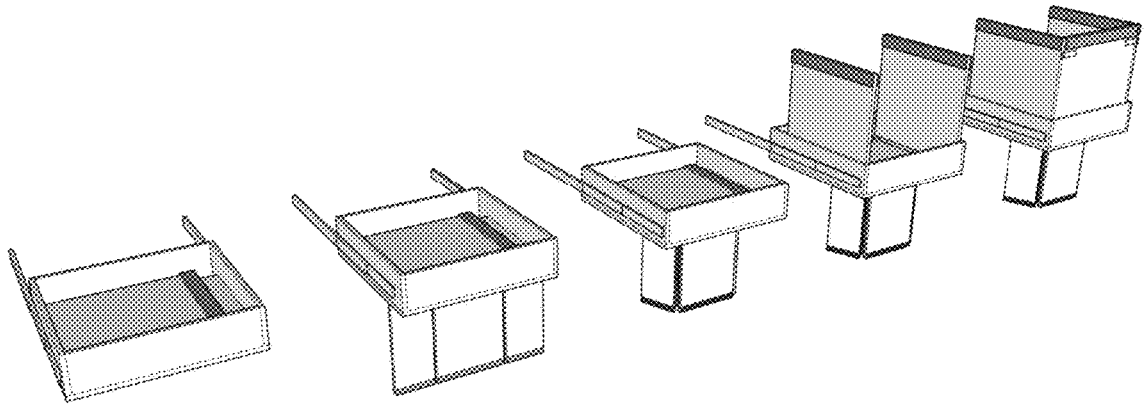
Figure 2:
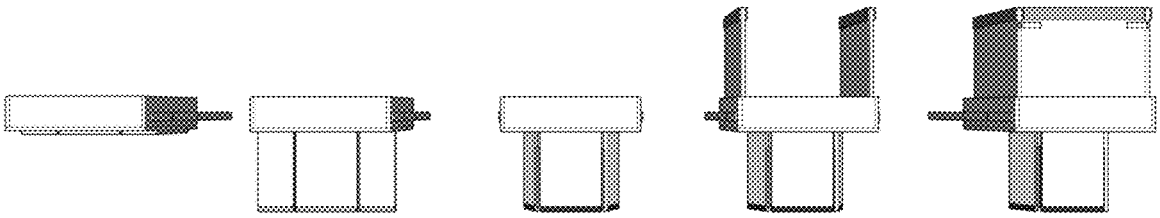
Figure 3:
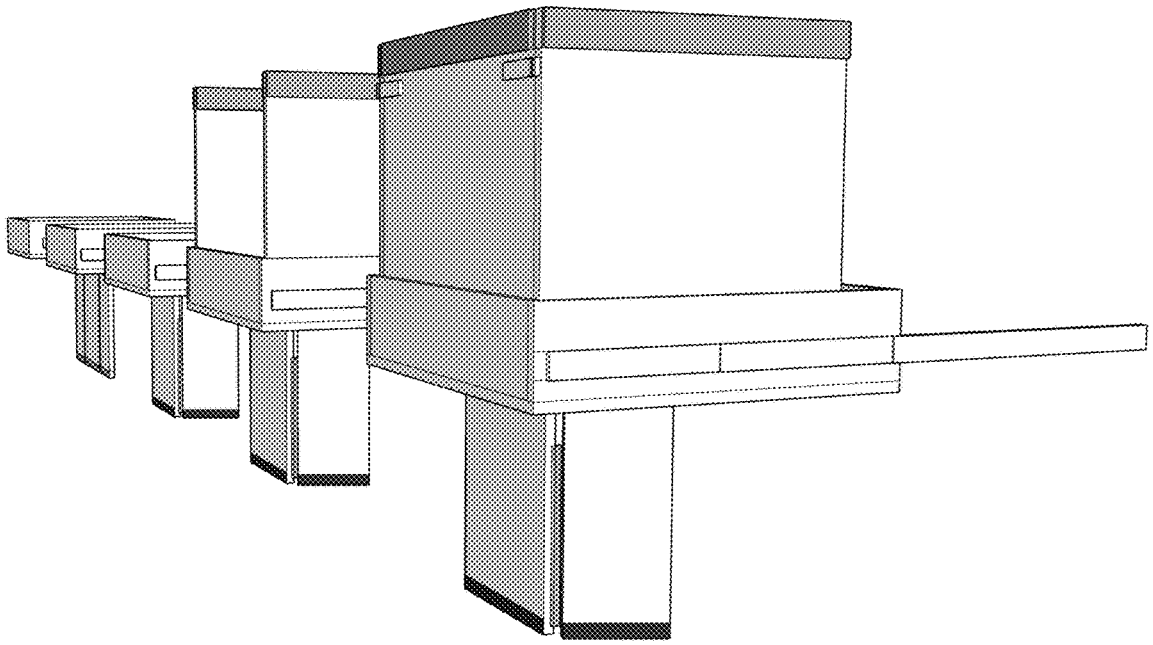
Figure 4:
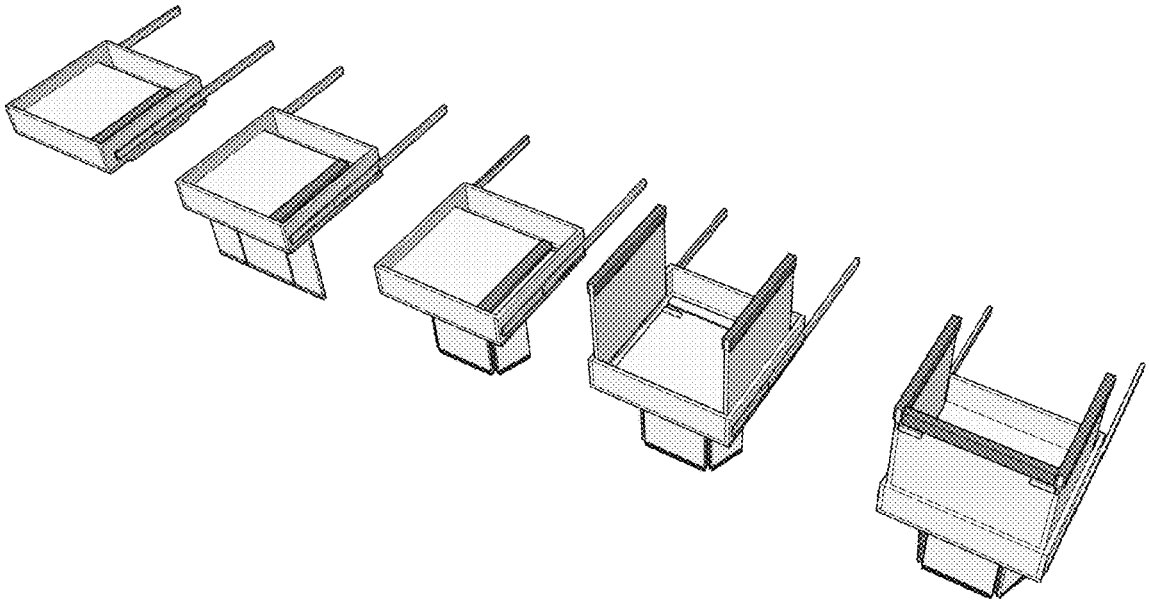
Figure 5:
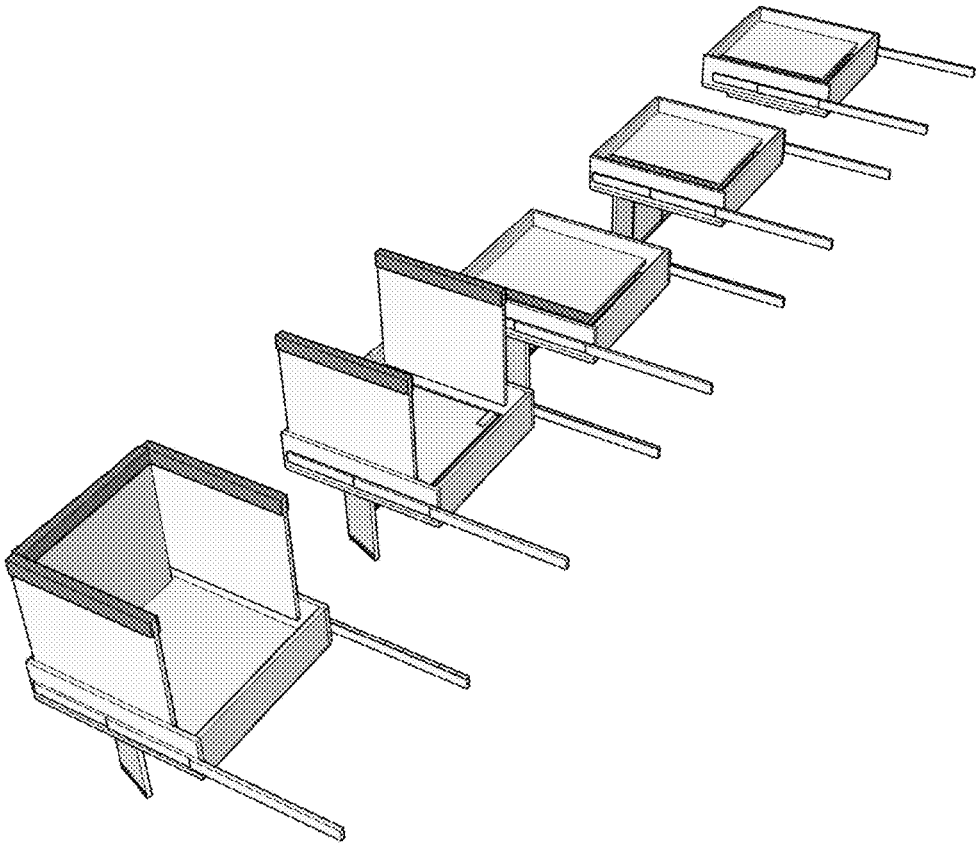
FIGS. 5-6 show the back of the drawer.
Figure 6:
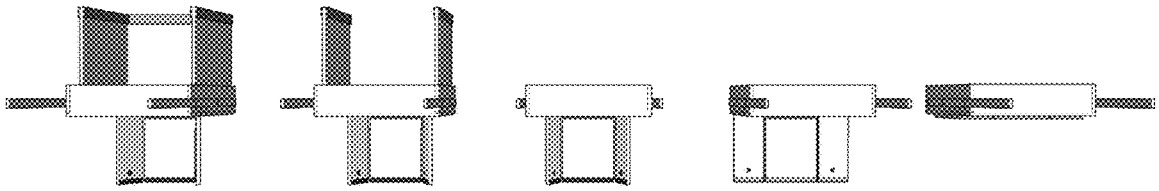
Figure 7:
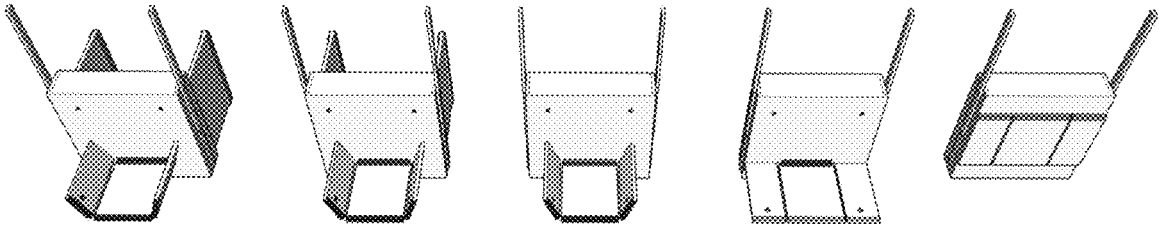
FIG. 7 shows the bottom of the drawer and how the load bearing support piece folds.
Figure 8:
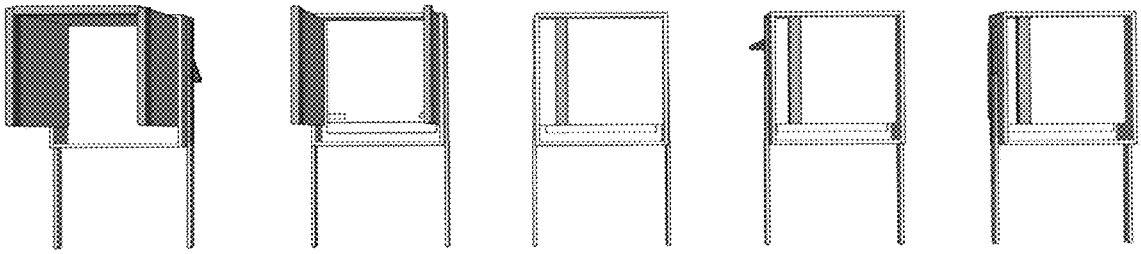
FIG. 8 shows the top of the device.
Figure 9:
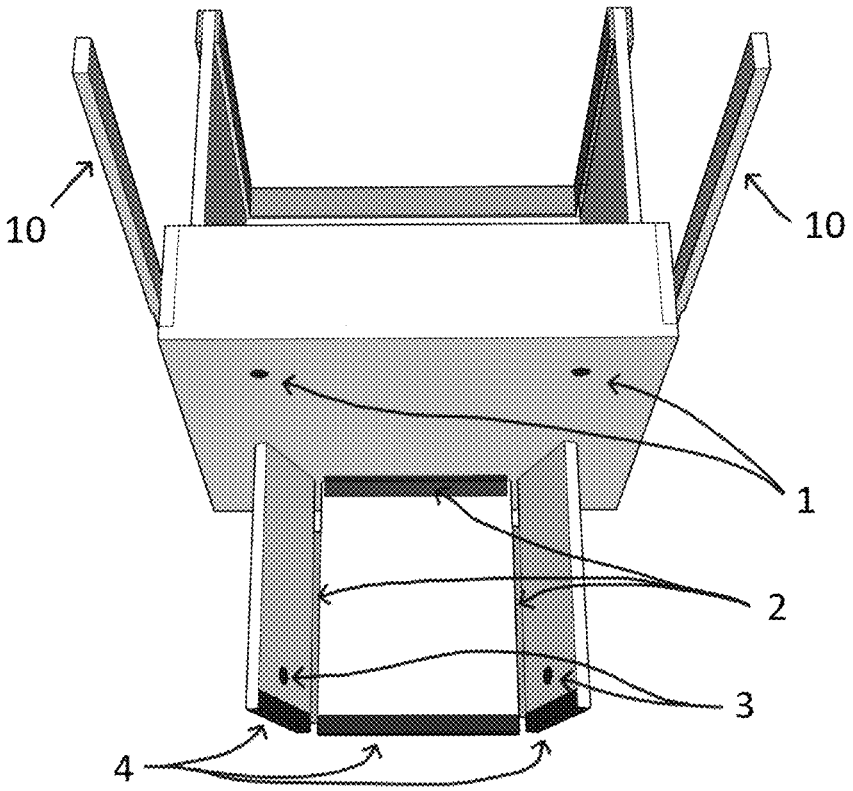
FIGS. 9-11 highlight specific components of the invention.
Figure 10:
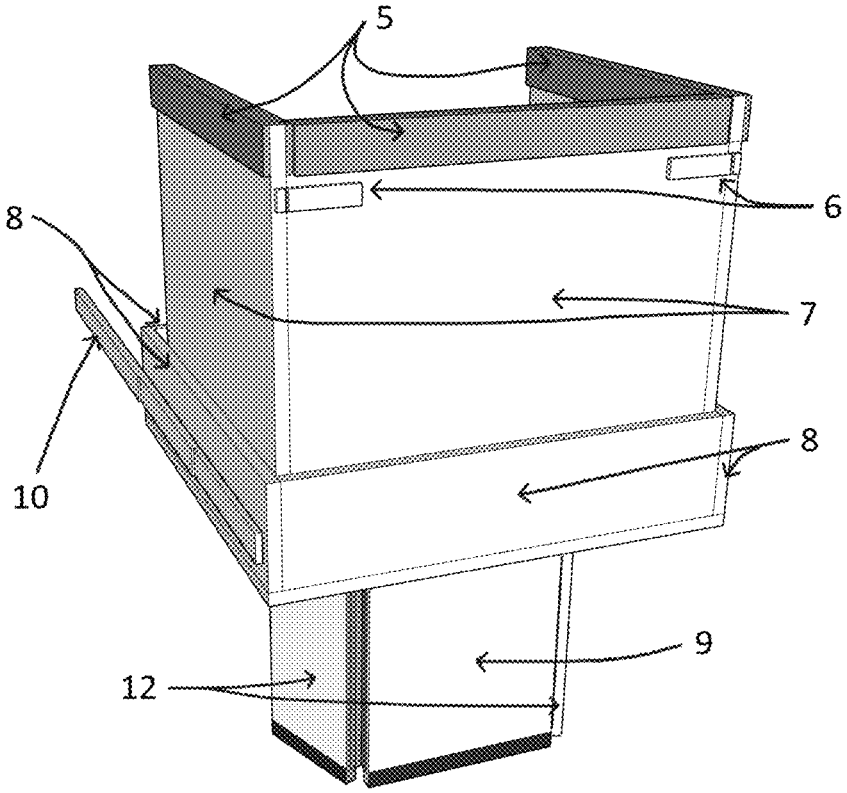
Figure 11:
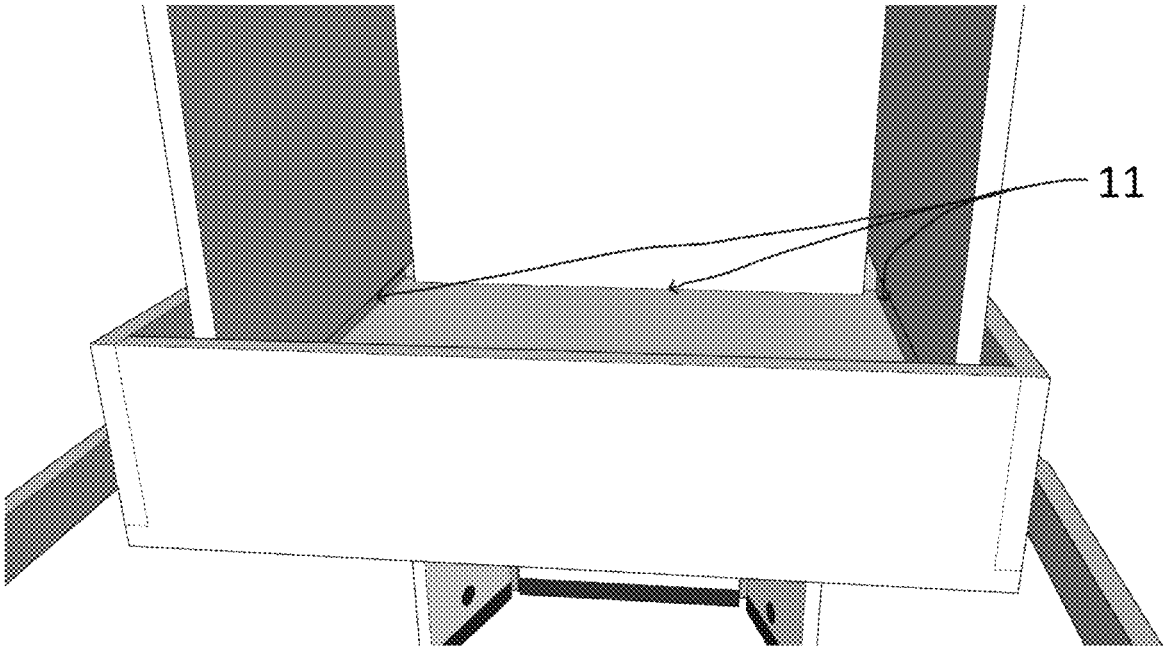

Going in numerical order, the components in FIGS. 9-11 include (1) and (3) magnets, (2) and (11) continuous hinges, also known as piano hinges, (4) anti-skid rubber material, (5) foam material for comfort, (6) safety latches similar to a deadbolt, (7) foldable containment/safety walls, (8) standard drawer walls that have no movement other than sliding in/out, (9) a leg/support that folds down when in use then folds back up and is held in place with magnets for storage, (10) full extension ball bearing drawer slides, and (12) the load bearing support leaves that fold inwards on hinges for extra stability.

DETAILED DESCRIPTION OF THE INVENTION

This versatile drawer is currently made from finished wood, metal hardware, and safety foam. The product could also be made from similar rigid materials such as plastic or metal. The invention slides out on heavy duty full extension ball bearing drawer slides. It can take the place of a standard cabinet drawer or be installed behind cabinet doors. Once extended from the cabinet, the safety walls fold up and the support folds down. The device must be in its maximally expanded position for the safety walls to fold up. The side safety walls fit snuggly against the existing cabinet/counter at maximal expansion of the drawer, and this tight fit prevents the ball bearing slides from moving in either direction when in use. The walls fold up in a particular order that allows them to be wedged into place with support from the other walls and the walls of the drawer. They are then locked into place with 2 metal locks. The ball bearing drawer slides allow a small amount of vertical movement that lets the bottom support piece be rotated down and into place when applying upward traction on the drawer. Once the upward force is released and the; pad bearing support leaves are folded inwards, the weight of the drawer, the weight of the child, and the grip on the bottom of the support keep it firmly in place.

If all children in the house grow out of the need for vertical assistance, the device can be quickly disassembled into a standard drawer by detaching 4 hinges.

SEQUENCE LISTING

Not Applicable

The invention claimed is:

1. A retractable device contained within a cabinet having drawers having a base that is designed to slide in/out and support a child at counter/table height comprising:

two full extension ball bearing slides (10) that the retractable device slides in/out on;

containment walls (7) that fold up using hinges (11) first when setting up the retractable device and secure the foldable containment walls to a drawer wall (8); said containment walls defining side safety walls a bottom support (9) that supports the drawer at a bottom surface thereof, is a rectangular structure and is the full width of the retractable device, folds downwards on a hinge (2) to support the drawer when it is fully extended, and then has lateral portions (12) that swing inward on hinges (2) to allow the device to be supported in more than one plane and therefore increase stability;

a front safety wall that folds up on a hinge (11) to tightly wedge between the side safety walls, thus preventing the side safety walls from folding in by opposition of the front safety wall and preventing them from folding outwards by the opposition of the lateral drawer box walls.

2. The retractable device of claim 1, wherein the front wall of retractable device locks into place with bolt action locking mechanisms (6) and is thus prevented from folding inward by these locks and prevented from folding outward by sidewalls of the drawer.

3. The retractable device of claim 1, wherein the bottom support is held on the underside of the drawer base with magnets (3) when not in use and has an anti-slip material (4) along a bottom portion of the bottom support that comes into contact with the ground.

4. The retractable device of claim 1, further comprising a top edge of the foldable walls are partially encased in foam (5), providing a safe place for children to play.

5. The retractable device of claim 1, wherein the containment walls fit snuggly against a counter overhang at maximal expansion of the drawer slides, which fit prevents the drawer from sliding in either direction when in use.

6. The retractable device of claim 1, in which disassembly occurs into a standard drawer by detaching four hinges (2) and (11) from the drawer walls (8) and removing all foldable containment walls and the bottom support.

* * * * *